US011028787B2

(12) United States Patent
Nagasaki et al.

(10) Patent No.: US 11,028,787 B2
(45) Date of Patent: Jun. 8, 2021

(54) CONTROL SYSTEM FOR INTERNAL COMBUSTION ENGINE

(71) Applicants: Taketo Nagasaki, Nagakute (JP); Daijiro Tanaka, Iwata (JP); Kouji Takasu, Hamamatsu (JP)

(72) Inventors: Taketo Nagasaki, Nagakute (JP); Daijiro Tanaka, Iwata (JP); Kouji Takasu, Hamamatsu (JP)

(73) Assignees: TOYOTA JIDOSHA KABUSHIKI KAISHA, Toyota (JP); Yamaha Motor Co., Ltd., Iwata-shi (JP)

( * ) Notice: Subject to any disclaimer, the term of this patent is extended or adjusted under 35 U.S.C. 154(b) by 15 days.

(21) Appl. No.: 16/430,481

(22) Filed: Jun. 4, 2019

(65) Prior Publication Data

US 2020/0003135 A1 Jan. 2, 2020

(30) Foreign Application Priority Data

Jun. 27, 2018 (JP) ..... JP2018-122230

(51) Int. Cl.

| | |
|---|---|
| ***F02D 41/40*** | (2006.01) |
| ***F02P 5/04*** | (2006.01) |
| ***F02D 35/02*** | (2006.01) |
| ***F02D 41/04*** | (2006.01) |
| *F02B 75/12* | (2006.01) |

(52) U.S. Cl.

CPC ..... *F02D 35/025* (2013.01); *F02D 41/047* (2013.01); *F02D 41/401* (2013.01); *F02P 5/045* (2013.01); *F02B 2075/125* (2013.01)

(58) Field of Classification Search

CPC .... F02D 35/025; F02D 41/401; F02D 41/047; F02D 2250/31; F02D 2041/0015; F02D 41/345; F02P 5/045; F02B 2075/125

See application file for complete search history.

(56) References Cited

U.S. PATENT DOCUMENTS

| | | | | |
|---|---|---|---|---|
| 4,495,924 A * | 1/1985 | Ueno | F02D 41/2403 | 123/475 |
| 4,955,339 A * | 9/1990 | Sasaki | F02B 3/02 | 123/295 |
| 5,127,378 A * | 7/1992 | Ito | F02D 41/345 | 123/300 |
| 5,711,269 A * | 1/1998 | Oda | F02B 17/005 | 123/262 |

(Continued)

FOREIGN PATENT DOCUMENTS

| | | |
|---|---|---|
| JP | 2011-012555 | 1/2011 |

*Primary Examiner* — Jacob M Amick
*Assistant Examiner* — Michael A Kessler
(74) *Attorney, Agent, or Firm* — Oblon, McClelland, Maier & Neustadt, L.L.P.

(57) ABSTRACT

The center injection engine is an engine equipped with the direct injector and an ignition apparatus at center of a ceiling part of the combustion chamber. The positive tumble flow flows from the intake port side to the exhaust port side on the ceiling part side of the combustion chamber, and also flows from the exhaust port side to the intake port side on the piston top part side. The ECU calculates the injection timing of the direct injector based on the engine load. In the first injection control, the higher the engine load becomes, the more the end crank angle is retarded.

2 Claims, 5 Drawing Sheets

(56) References Cited

U.S. PATENT DOCUMENTS 5,732,674 A * 3/1998 Motoyama ..... F02B 61/02 123/299
6,032,637 A * 3/2000 Mamiya ..... F02D 35/00 123/295
6,047,948 A * 4/2000 Hasegawa ..... F02M 51/0653 251/129.18
6,240,724 B1 * 6/2001 Kudou ..... F01N 3/2006 123/478
6,505,601 B1 * 1/2003 Jorach ..... F02B 1/12 123/295
9,695,770 B2 * 7/2017 Takahashi ..... F02D 41/3011
2002/0026924 A1 * 3/2002 Morikawa ..... F02B 1/12 123/305
2006/0016431 A1 * 1/2006 Mashiki ..... F02P 5/152 123/431
2008/0000445 A1 * 1/2008 Kim ..... F02D 41/0025 123/295
2008/0295798 A1 * 12/2008 Reitz ..... F02D 41/3035 123/299
2010/0242923 A1 * 9/2010 Okada ..... F02M 37/0029 123/511
2010/0332109 A1 12/2010 Miura
2012/0216776 A1 * 8/2012 Nagatsu ..... F02B 23/101 123/305
2014/0039780 A1 * 2/2014 Berkemeier ..... F02D 35/026 701/104
2014/0060490 A1 * 3/2014 Iwai ..... F02P 5/152 123/478
2014/0069382 A1 * 3/2014 Iwai ..... F02D 41/1446 123/406.47
2014/0238340 A1 * 8/2014 Dunn ..... F02M 43/00 123/299
2015/0083073 A1 * 3/2015 Nagatsu ..... F02D 41/3035 123/294
2016/0115895 A1 * 4/2016 Ochi ..... F02D 41/3017 123/305
2016/0201635 A1 * 7/2016 Nagano ..... F02P 5/045 123/491
2017/0009698 A1 * 1/2017 Tsugawa ..... F02D 41/401
2017/0022892 A1 * 1/2017 Fujimoto ..... F02B 47/02
2017/0022938 A1 * 1/2017 Fujimoto ..... F02M 25/03
2017/0342936 A1 * 11/2017 Pursifull ..... F02D 41/3845
2019/0101071 A1 * 4/2019 Inoue ..... F02D 1/18
2019/0107061 A1 * 4/2019 Inoue ..... F02D 45/00
2019/0112988 A1 * 4/2019 Inoue ..... F02D 41/3047
2019/0145337 A1 * 5/2019 Tanaka ..... F02D 41/3041 123/294
2019/0360449 A1 * 11/2019 Inoue ..... F02P 5/1502

* cited by examiner

CONTROL SYSTEM FOR INTERNAL COMBUSTION ENGINE

CROSS-REFERENCE TO RELATED APPLICATION

The present disclosure claims priority under 35 U.S.C. § 119 to Japanese Patent Application No. 2018-122230, filed on Jun. 27, 2018. The content of the application is incorporated herein by reference.

TECHNICAL FIELD

The present disclosure relates to a control system for internal combustion engine.

BACKGROUND

JP 2011-012555 A discloses a system for controlling an engine provided with an injector which is configured to inject into a combustion chamber directly ((hereinafter, also referred to as a "direct injector"). This conventional system changes injection timing of the direct injector according to operating state of the engine. Specifically, this conventional system advances the injection timing when the operating state is in a high-load region.

The fuel injection from the direct injector is performed during intake stroke of the engine. Therefore, when the injection timing approaches BDC (Bottom Dead Center), the injected fuel directly hits and adheres to a cylinder wall of the engine, which dilutes engine oil (e.g., lubricating oil). Since an amount of the injected fuel is large in the high-load region, when the injection timing approaches the BDC, the amount of the fuel adhering to the cylinder wall increases. In this respect, with the advance of the injection timing in the high-load region, it is possible to reduce the adhesion amount of the fuel and suppress the dilution of the engine oil.

Considering a center injection engine in which tumble flow is generated in the combustion chamber. The center injection engine is an engine equipped with the direct injector and an ignition apparatus at center of a ceiling part of the combustion chamber. The tumble flow is assumed to flow from an intake port side to an exhaust port side on the ceiling part side of the combustion chamber (i.e., a bottom side of a cylinder head) and also to flow from the exhaust port side to the intake port side on a top part side of a piston. Hereinafter, the tumble flow flowing in such a direction is defined as "positive tumble flow".

The engine constituting the conventional system has the direct injector at a side part of the combustion chamber, and the cylinder wall surface is located ahead of the injection direction. On the other hand, in the center injection engine, the piston top part is located ahead of the injection direction. For this reason, when injection control same as that of the conventional system is applied to the center injection engine during the high-load region of the engine, the following problem arises. That is, when the injection timing is advanced in the high-load region, the injected fuel is likely to adhere to the piston top part.

However, when another injection control is executed in order to reduce the adhesion amount of the fuel to the piston top part, the following problem arises newly. That is, when the injection timing is retarded in the high-load region, the positive tumble flow in the combustion chamber starts to be disturbed in middle stage of the intake stroke. Then, engine output drops in the high-load region where high output is expected under ordinary circumstances.

The present disclosure addresses the above described problem, and an object of the present disclosure is, to suppress degradation of the engine output in the high-load region of the center injection engine equipped with the combustion chamber in which the positive tumble flow is generated.

SUMMARY

A first aspect of the present disclosure is a control system for internal combustion engine for solving the problem described above, and has the following features.

The control system comprises a combustion chamber of an internal combustion engine, an ignition apparatus, a direct injector and a control unit.

In the combustion chamber, positive tumble flow is generated.

The ignition apparatus is provided substantially at center of a ceiling part of the combustion chamber.

The direct injector is provided adjacent to the ignition apparatus.

The control unit is configured to control injection timing of the direct injector based on load of the engine.

The control unit is further configured to:

control the injection timing to a crank angle section corresponding to intake stroke of the engine in a low-load region of the engine; and control at least end crank angle of the injection timing in a high-load region of the engine on a retard side as compared to that of the injection timing in the low-load region, The end crank angle of the injection timing in the high-load region is within a crank angle section corresponding to a first half of compression stroke of the engine.

A second aspect of the present disclosure has the following features according to the first aspect.

The control system further comprises a fuel tubing.

The fuel tubing is configured to provide the direct injector with fuel in compressed state.

The control unit is further configured to control fuel pressure in the fuel tubing based on the engine load when the engine load is in the high-load region.

The fuel pressure decreases as the engine load increases.

A third aspect of the present disclosure has the following features according to the first aspect.

The control unit is further configured to control start crank angle of the injection timing in the high-load region to the retard side as compared to that of the injection timing in the low-load region.

The start crank angle of the injection timing in the high-load region is within the crank angle section corresponding to the intake stroke of the engine.

According to the first aspect, the end crank angle in the high-load region is retarded to the first half of the compression stroke. When the end crank angle is retarded to the first half of the compression stroke, there is a disadvantage that the positive tumble flow starts to be disrupted in the middle of the intake stroke. However, according to inventors of the present disclosure, it was found that when the end crank angle is retarded to the first half of the compression stroke, a merit exceeding this disadvantage is obtained in the center injection engine. Specifically, when the end crank angle is retarded to the first half of the compression stroke, strong turbulence state of air-fuel mixture is maintained until just before an ignition. Therefore, according to the first aspect, it is possible to suppress the degradation of the engine output in the high-load region by the advantage over the disadvantages.

According to the second aspect, in the high-load region, the fuel pressure of the fuel tubing is controlled to a lower value as the engine load increases. Therefore, it is possible to retard the end crank angle to the first half of the compression stroke.

According to the third aspect, the start crank angle in the high-load region is retarded to the crank angle section corresponding to the intake stroke. Therefore, it is possible to retard the end crank angle to the first half of the compression stroke without changing the fuel pressure of the fuel tubing.

DESCRIPTION OF EMBODIMENT

Figure 1:
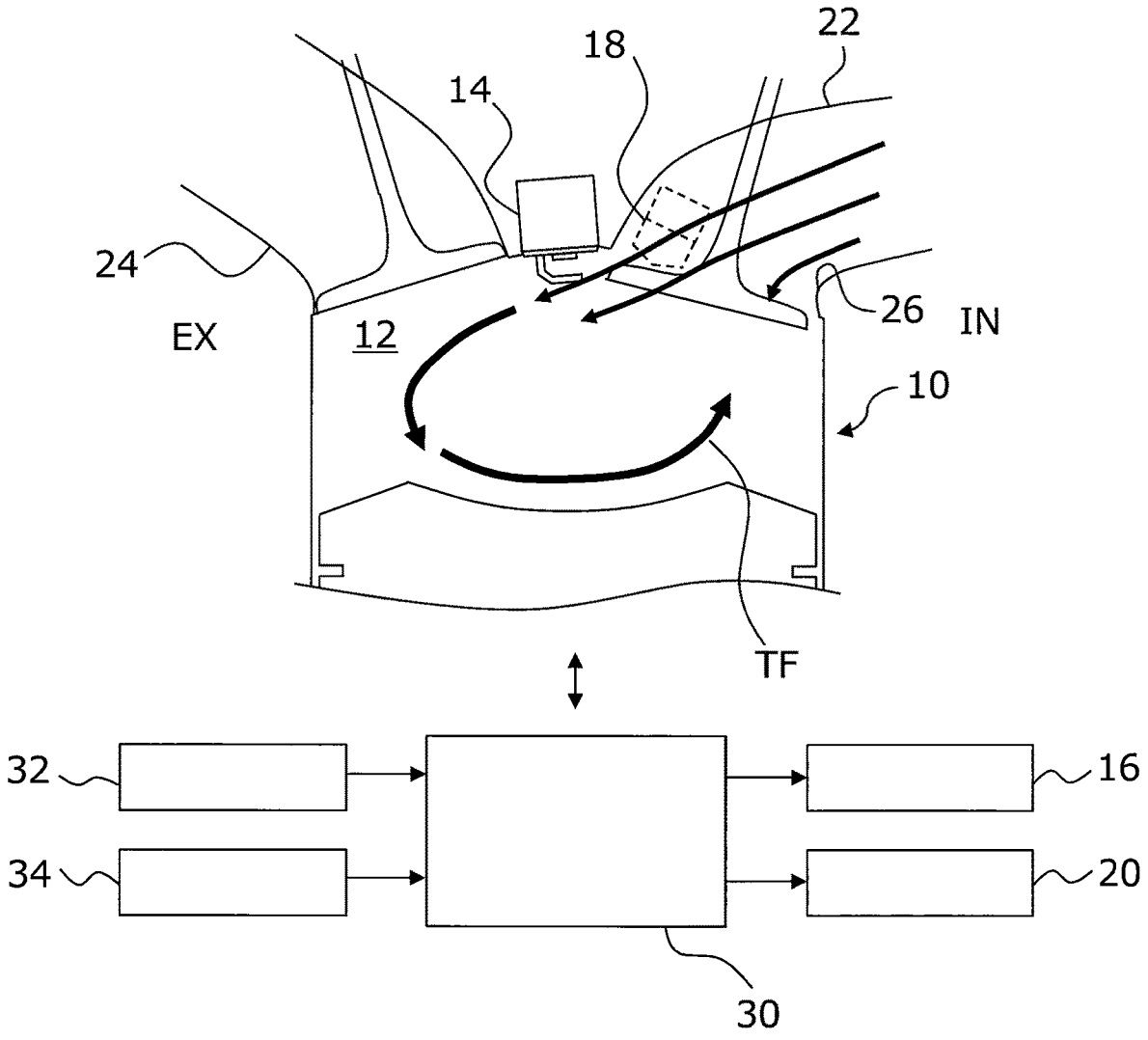
FIG. 1 is a diagram for explaining a configuration of an internal combustion engine system according to an embodiment of the present disclosure.

Hereinafter, an embodiment of the present disclosure will be described based on the accompanying drawings. Note that elements that are common to the respective drawings are denoted by the same reference characters and a duplicate description thereof is omitted. Further, the present disclosure is not limited to the embodiment described hereinafter.

1. System Configuration

FIG. 1 is a view for explaining a configuration of an internal combustion engine system according to an embodiment of the present disclosure. The system shown in FIG. 1 includes an internal combustion engine (hereinafter also referred to as an "engine") 10 mounted on a vehicle. The engine 10 is a four-stroke cycle engine. The engine 10 is also a center injection engine. The engine 10 is also an engine with turbocharger constituting a turbocharging system. The turbocharging system is, for example, a system in which intake air is compressed with energy of exhaust of the engine 10. However, such a turbocharging system is not necessary for present disclosure, so illustration is omitted.

The engine 10 has a plurality of cylinders. However, only one cylinder is drawn in FIG. 1. A combustion chamber 12 is formed for each cylinder. The combustion chamber 12 is generally defined as a space surrounded by a bottom surface of a cylinder head, a wall surface of a cylinder block and a top surface of a piston.

A spark plug 14 is attached to a ceiling part of the combustion chamber 12. A mounting position of the spark plug 14 is approximately at the center of the ceiling part. The spark plug 14 is connected to an ignition coil 16 that applies a high voltage to the spark plug 14. The spark plug 14 and the ignition coil 16 constitute an ignition apparatus. When the ignition coil 16 is driven by an ECU (Electronic Control Unit) 30, a discharge spark is generated at the spark plug 14.

To the ceiling part, a direct injector 18 is also attached. The mounting position of the direct injector 18 is closer to an intake port 22 than that of the spark plug 14. The direct injector 18 is connected to a fuel supply system provided with at least a fuel pump 20. The fuel pump 20 pressurizes fuel pumped from a fuel tank and provides it to a fuel tubing. When the direct injector 18 is driven by the ECU 30, fuel in compressed state is injected from the direct injector 18. A plurality of injection holes are formed radially at a tip part of the direct injector 18. Therefore, the fuel in compressed state is injected radially.

The intake port 22 communicates with the combustion chamber 12. As well as the intake port 22, an exhaust port 24 communicate with the combustion chamber 12. The intake port 22 extends generally straight from an upstream to a downstream side. A cross sectional area of the intake port 22 is narrowed at a throttle part 26 which is a connecting part with the combustion chamber 12. Such a shape of the throat part 26 generates a positive tumble flow TF in the intake air sucked into the combustion chamber 12 from the intake port 22. The positive tumble flow TF flows from the intake port 22 side to the exhaust port 24 side on the ceiling part side of the combustion chamber 12 and also flows from the exhaust port 24 side to the intake port 22 side on the top surface side of the piston.

The system shown in FIG. 1 also includes the ECU 30 as a control unit. The ECU 30 includes a random access memory (RAM), a read only memory (ROM) and a central processing unit (CPU). The ECU 30 takes in and processes signals of various sensors mounted on the vehicle.

The various sensors include at least a crank angle sensor 32 and a fuel pressure sensor 34. The crank angle sensor 32 detects rotation angle of a crankshaft. The fuel pressure sensor 34 detects a fuel pressure in the fuel tubing. The ECU 30 processes the signal of each sensor taken in and operates various actuators in accordance with a predetermined control program. The actuators operated by the ECU 30 include the ignition coil 16, the direct injector 18 and the fuel pump 20.

2. Characteristics of Engine Control Related to Present Embodiment

The ECU 30 executes engine control. The engine control includes fuel injection control of the direct injector 18. In the fuel injection control, the ECU 30 calculates injection amount of fuel based on an operating state of the engine 10. The operating state is specified by rotation speed and load of the engine 10. The injection amount of fuel is basically set to a larger value as the rotation speed or the engine load becomes higher. Further, the ECU 30 calculates injection timing based on the engine load. The injection timing is basically set to a crank angle section corresponding to intake stroke of the engine 10, and is set to a retard side as the engine load becomes higher.

2.1 Relationship Between Lift Amount and Tumble Ratio

Figure 2:
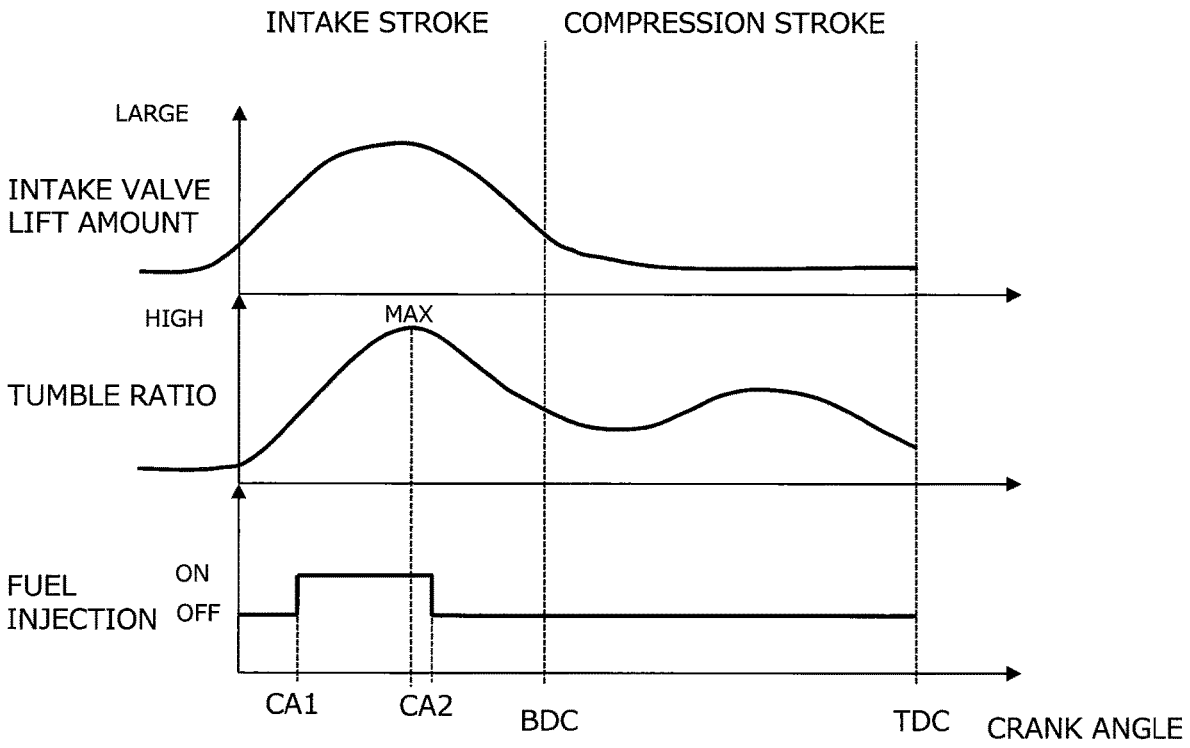
FIG. 2 is a view for explaining a relationship between lift amount of an intake valve and tumble ratio.

In this embodiment, the positive tumble flow TF is used to improve state of air-fuel mixture in the combustion chamber 12 just before ignition. FIG. 2 is a view for explaining the relationship between a lift amount of an intake valve and a tumble ratio. Note that the relationship is established under a condition where the rotational speed is constant. The tumble ratio is defined as a value obtained by angular velocity of the positive tumble flow TF divided by the rotational speed. As shown in FIG. 2, when the lift amount increases in accordance with an opening operation of the intake valve, the tumble ratio increases. The tumble ratio becomes a maximum value near crank angle where the lift amount is the largest. The tumble ratio falls in accordance with a closing operation of the intake valve. The tumble ratio temporarily rises in compression stroke of the engine 10. This is due to the movement of the piston to the TDC.

Crank angle CA1 shown in FIG. 2 is start crank angle of an injection period, and crank angle CA2 is end crank angle of the injection period. The crank angle CA1 is defined as crank angle included in a crank angle section in which the tumble ratio rises and reaches the maximum value. The crank angle CA2 is defined as crank angle where the tumble ratio starts to fall from the maximum value. By setting such injection period specified with the crank angles CA1 and CA2, it is possible to promote to mix the injected fuel and air in the combustion chamber 12 by using strong positive tumble flow TF. In other words, it is possible to promote homogenization of the mixture in the combustion chamber 12. Therefore, it is possible to improve fuel consumption of the engine 10.

2.2 Problems in High Engine Load Region

Under a condition where the fuel pressure is constant, it is necessary to extend the injection period as the injection amount of fuel increases. In other words, under the condition where the fuel pressure is constant, the injection period from a middle engine load region to a high engine load region needs to be advanced or retarded relative to that in a low engine load region.

Figure 3:
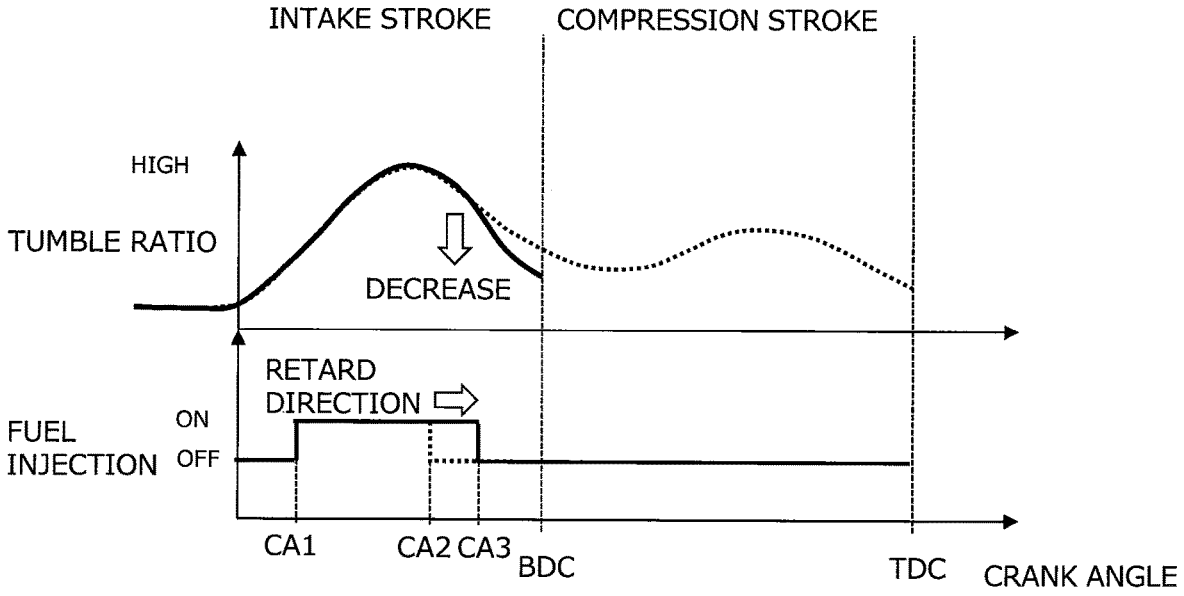
FIG. 3 is a view for explaining a problem when injection timing is retarded to a BDC side with an extension of an injection period.

However, when the injection timing is retarded with the extension of the injection period, the following problems are developed. FIG. 3 is a diagram for explaining the problems when the injection timing is retarded. In FIG. 3, the end crank angle (i.e., crank angle CA3) is brought close to the BDC without changing the start crank angle (i.e., crank angle CA1). The crank angle CA3 is defined as crank angle included in a crank angle section on the BDC side of the crank angle at which the tumble ratio is the maximum value. Therefore, as shown by the solid line in FIG. 3, the fuel injected in the crank angle section on the BDC side promotes lowering of the tumble ratio. As a result, the positive tumble flow TF starts to be disturbed in the middle of the intake stroke. Then, speed of the homogenization of the mixture slows down and the improvement in the fuel consumption owing to the positive tumble flow TF is lost.

Figure 4:
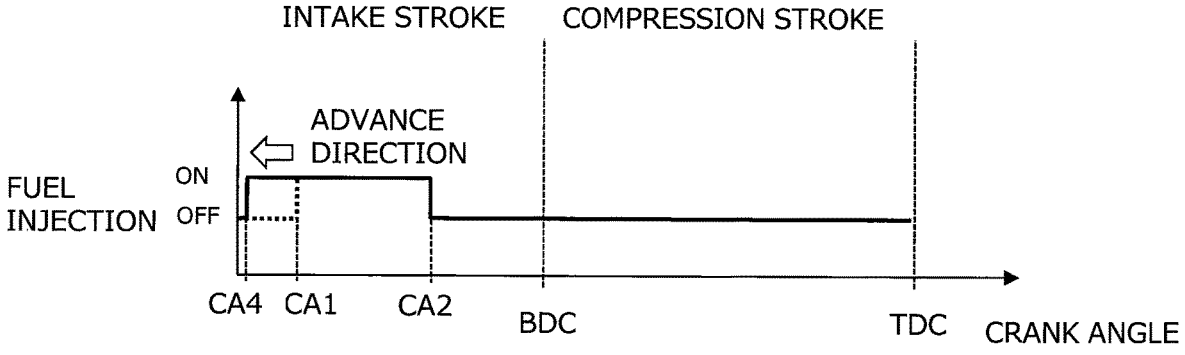
FIG. 4 is a diagram for explaining a problem when the injection timing is advanced to a TDC side with the extension of the injection period.

On the other hand, when the injection timing is advanced with the extension of the injection period, the following problems are developed. FIG. 4 is a diagram for explaining the problems when the injection timing is advanced. In FIG. 4, the start crank angle (i.e., crank angle CA4) is brought away from the BDC without changing the end crank angle (i.e., crank angle CA2). When the injection is started from the crank angle CA4, the injected fuel is directly hit to the piston top surface of the piston and smoke is easily generated. This is because that a distance between the tip part and the piston top surface is short at the crank angle CA1.

2.3 Outline of Engine Control in Present Embodiment

Figure 5:
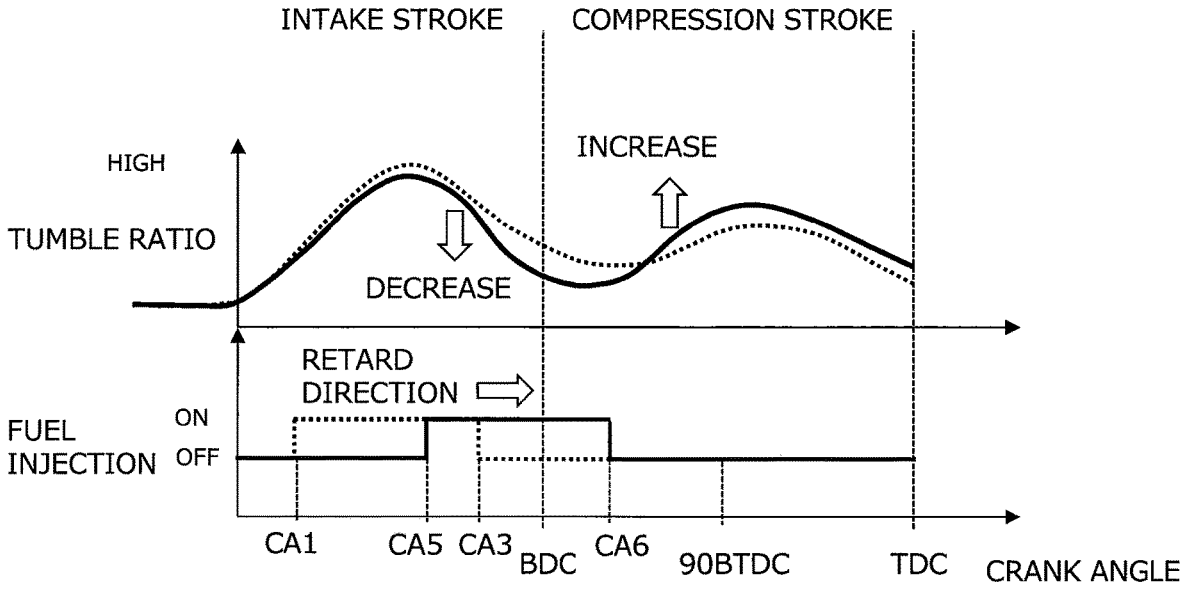
FIG. 5 is a view for explaining an outline of fuel injection control in the embodiment.

In light of these problems, in the fuel injection control, the injection timing is retarded by a large extent in the high engine load region. FIG. 5 is a diagram for explaining an outline of the fuel injection control executed in the embodiment. In FIG. 5, the start crank angle (i.e., crank angle CA5) and the end crank angle (i.e., crank angle CA6) are retarded so that the injection timing crosses the BDC. As described in the explanation of FIG. 3, when the end crank angle approaches the BDC, it prompts the lowering of the tumble ratio. This disadvantage also applies to the fuel injection control in which the injection timing crosses the BDC.

However, in the fuel injection control of this embodiment, the crank angle CA6 is retarded to a crank angle section corresponding to a first half of the compression stroke (i.e., a crank angle section between the BDC and 90BTDC). Therefore, as shown by the solid line in FIG. 5, it is possible to increase a rising level of tumble ratio which rises temporarily during the compression stroke. In other words, it is possible to suppress the angular velocity of the positive tumble flow TF and to slow down the disintegration thereof.

The ignition of the mixture is performed near the TDC. Also, normally, due to the movement of the piston to the TDC, the positive tumble flow TF is disintegrated in a crank angle section corresponding to a second half of the intake stroke (i.e., a crank angle section between the 90BTDC to the TDC). In this respect, when the disintegration of the positive tumble flow TF is slowed down, it is possible to proceed the homogenization of the mixture until just before the ignition.

When the end crank angle is retarded to the first half of the compression stroke, in addition to the disadvantages described in the explanation of FIG. 3, there is another disadvantage that temperature drop of the mixture owing to the injected fuel's evaporative latent heat is suppressed. However, according to a survey of the inventors of the present disclosure, it was confirmed in the high engine load region of the center injection engine that when the end crank angle is retarded to the first half of the compression stroke, a merit associated with the progress of the homogenization of the mixture outweighs these disadvantages.

2.4 Outline of Another Engine Control in Present Embodiment

Figure 6:
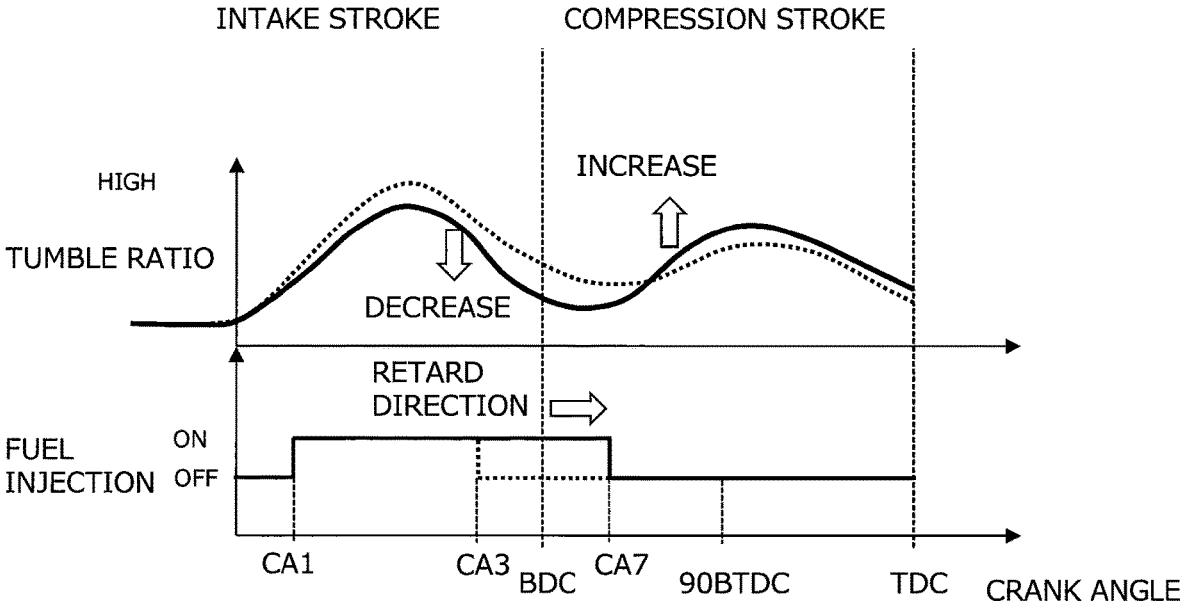
FIG. 6 is a diagram for explaining an outline of another fuel injection control in the embodiment.

FIG. 6 is a diagram for explaining an outline of another fuel injection control executed in the embodiment. In FIG. 6, without changing the start crank angle (crank angle CA1), the end crank angle (i.e., crank angle CA7) is retarded so that the injection timing crosses the BDC. Note that the start crank angle may be crank angle different from the crank angle CA1. That is, the start crank angle may be crank angle in the retard side or in the advance side rather than the crank angle CA1.

In the fuel injection control described in FIG. 5, it was assumed that the fuel pressure is constant in the high engine load region. On the other hand, the fuel injection control described in FIG. 6 is executed simultaneously with fuel pressure control in which the fuel pressure is lowered in the high engine load region. When the fuel pressure control is executed simultaneously with the fuel injection control, it is possible to retard the end crank angle to the first half of the compression stroke.

By retarding the end crank angle to the first half of the compression stroke, it is possible to increase the rising level of the tumble ratio which rises temporarily during the compression stroke. And according to the survey of the inventors of the present disclosure, with a combination of the fuel pressure control and the fuel injection control, it was confirmed that the same merit is obtained as the fuel injection control explained with reference to FIG. 5.

Hereinafter, for convenience of explanation, the fuel injection control explained with reference to FIG. 5 is also referred to as "first injection control", and the fuel injection control explained with reference to FIG. 6 is also referred to as "second injection control"

2.5 Other Advantageous Effects According to First or Second Injection Control

Figure 7:
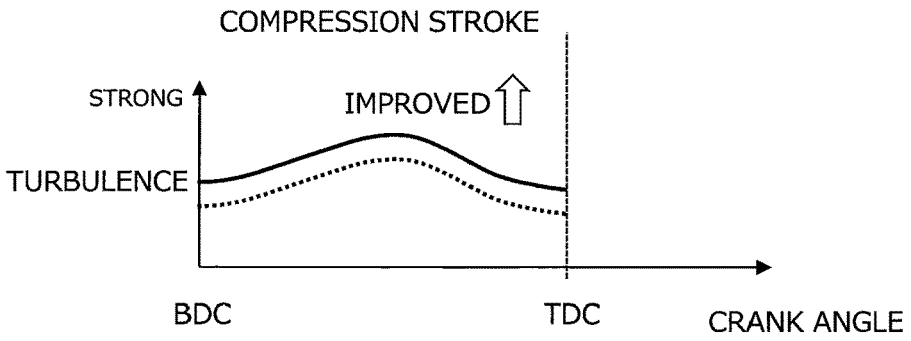
FIG. 7 is a diagram for explaining turbulence state of air-fuel mixture during the compression stroke.

Separately from the advantageous effects explained above, other effects according to the first or second injection control will be described with reference to FIG. 7. FIG. 7 is a diagram for explaining turbulence state of the mixture during the compression stroke. The broken line shown in FIG. 7 represents transition of the disturbance before retarding the end crank angle whereas the solid line represents that after retarding the end crank angle. As can be seen by comparing the two lines, when the end crank angle is retarded to the first half of the compression stroke, the transition of the disturbance is maintained in a high state until crank angle approaches to the TDC. That is, the high turbulence state is maintained until just before the ignition.

The fact that the high turbulence state is maintained until just before the ignition means that flame generated by the ignition of the mixture is in an environment easy to propagate to surroundings. Therefore, according to first or second injection control, it is possible to increase speed of the flame propagation and improve the engine output.

3. Specific Example of Fuel Injection Control

Next, specific examples of first or second injection control will be described with reference to FIGS. 8 and 9.

3.1 Example of First Injection Control

Figure 8:
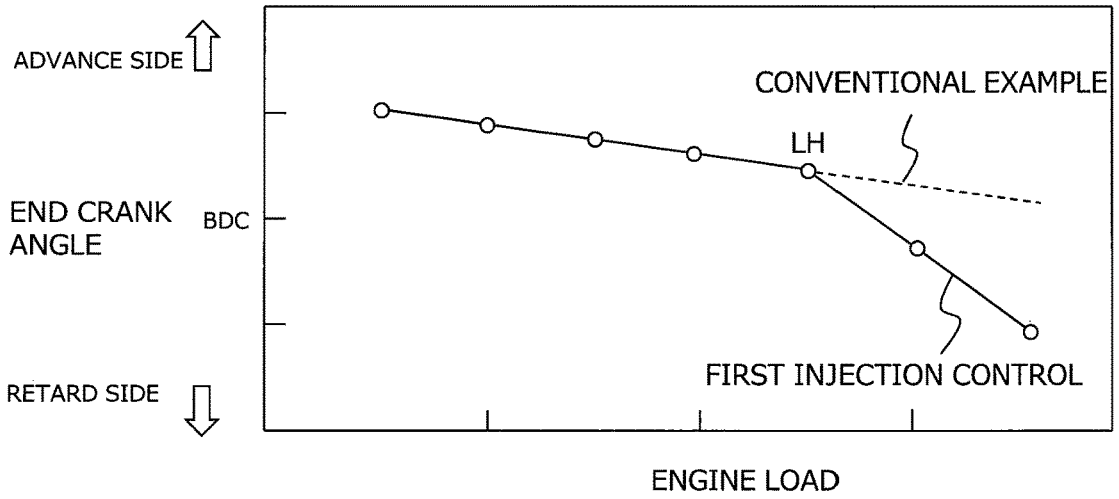
FIG. 8 is a view for explaining an example of fuel injection control (i.e., a first injection control) in the embodiment.

FIG. 8 is a diagram for explaining a specific example of the first injection control. The horizontal axis of FIG. 8 indicates the engine load, and the vertical axis indicates the end crank angle of the injection timing. As shown in FIG. 8, in the first injection control, the higher the engine load becomes, the more the end crank angle is retarded. However, unlike the "conventional example" indicated by the broken line in FIG. 8, in the first injection control indicated by the solid line, the end crank angle is retarded to a large extent in the high engine load region. Note that an engine load LH at which the end crank angle is retarded to the large extent is set, for example, according to the engine load region where a throttle valve is fully opened.

By storing the relationship shown in FIG. 8 in the memory of the ECU 30 in the form of a control map, and by controlling the injection timing based on this control map, it is possible to obtain the same effects in fuel consumption and engine output as those obtained by the execution of the first injection control.

3.2 Example of Second Injection Control

Figure 9:
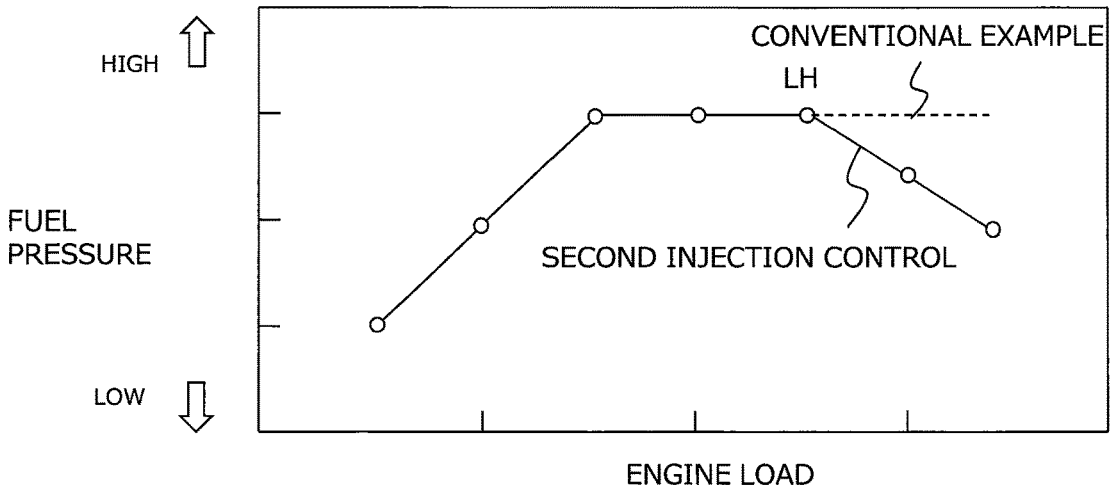
FIG. 9 is a view for explaining an example of another fuel injection control (i.e., second injection control) in the embodiment.

FIG. 9 is a diagram for explaining a specific example of the second injection control. The horizontal axis of FIG. 9 indicates the engine load, and the vertical axis indicates the fuel pressure. As shown in FIG. 9, in the second injection control, the fuel pressure is adjusted to a higher value as the engine load becomes higher in the low engine load region. Also, the fuel pressure is adjusted to the maximum value in the middle engine load region. Further, in the high engine load region, the fuel pressure is adjusted to a lower value as the engine load becomes higher. The adjustment of the fuel pressure is realized by controlling of the fuel pump 20. As to the control method for the fuel pump 20, a known method is applied.

By storing the relationship shown in FIG. 9 in the memory of the ECU 30 in the form of a control map, and by controlling the fuel pressure based on this control map while controlling the injection timing so that the end crank angle is within the first half of the compression stroke, it is possible to obtain the same effects in fuel consumption and engine output as those obtained by the execution of the second injection control.

What is claimed is:

1. A control system for an internal combustion engine comprising a combustion chamber of the internal combustion engine in which positive tumble flow is generated; an ignition apparatus which is provided as a center of a ceiling part of the combustion chamber; and a direct injector which is provided adjacent to the ignition apparatus, the control system comprising:

a control unit which is configured to control injection timing of the direct injector based on a load of the engine, wherein when the load of the engine is below a predetermined load, the control unit is configured to control the injection timing to a first crank angle section with a first start crank angle and a first end crank angle which are both within an intake stroke of the engine, wherein in a first control mode, when the load of the engine is greater than the predetermined load, the control unit is configured to control the injection timing to a second crank angle section with a second start crank angle and a second end crank angle, the second start crank angle being within the intake stroke of the engine and on a retard side of the first crank angle; and the second end crank angle being within a first half of a compression stroke of the engine, wherein in a second control mode, when the load of the engine is greater than the predetermined load the control unit is configured to control the injection timing to a third crank angle section, a start crank angle of the third crank angle section being the same as the first crank angle, and an end crank angle of the third crank angle section being within the first half of the compression stroke of the engine, and wherein in the second control mode the control unit is configured to decrease fuel pressure in a fuel tubing providing the direct injector with fuel in a compressed state from a maximum value.

2. The control system according to claim 1, wherein, in the second control mode, the control unit is configured to decrease the fuel pressure as the engine load increases.

* * * * *